US011006767B1

(12) United States Patent
Lee

(10) Patent No.: US 11,006,767 B1
(45) Date of Patent: May 18, 2021

(54) BABY CARRIER

(71) Applicant: I-ANGEL CO., LTD., Gyeonggi-do (KR)

(72) Inventor: Jin-Seop Lee, Gyeonggi-do (KR)

(73) Assignee: I-ANGEL CO., LTD., Gyeonggi-do (KR)

( * ) Notice: Subject to any disclaimer, the term of this patent is extended or adjusted under 35 U.S.C. 154(b) by 0 days.

(21) Appl. No.: 16/628,102

(22) PCT Filed: Feb. 8, 2018

(86) PCT No.: PCT/KR2018/001727
§ 371 (c)(1),
(2) Date: Jan. 2, 2020

(87) PCT Pub. No.: WO2019/009493
PCT Pub. Date: Jan. 10, 2019

(30) Foreign Application Priority Data

Jul. 3, 2017 (KR) ..... 10-2017-0084472

(51) Int. Cl.
*A47D 13/02* (2006.01)
*A41F 9/02* (2006.01)

(52) U.S. Cl.
CPC ..... *A47D 13/025* (2013.01); *A41F 9/025* (2013.01)

(58) Field of Classification Search
CPC ..... A47D 13/02; A47D 13/025; A47D 13/08; A45F 2003/144; A45F 3/14; A45F 5/021; F16M 13/04
USPC ..... 224/158–160, 270
See application file for complete search history.

(56) References Cited

U.S. PATENT DOCUMENTS 1,464,404 A * 8/1923 Blekastad ..... A47D 13/025 224/159
5,222,641 A * 6/1993 Medeiros, Jr. ..... A47D 13/025 224/161
5,224,637 A * 7/1993 Colombo ..... A47D 13/025 224/158
5,492,256 A * 2/1996 Ive ..... A47D 13/025 220/528

(Continued)

FOREIGN PATENT DOCUMENTS

CN 105902058 A 8/2016
JP 2504071 Y2 7/1996

(Continued)

*Primary Examiner* — Adam J Waggenspack
(74) *Attorney, Agent, or Firm* — Saliwanchik, Lloyd & Eisenschenk

(57) ABSTRACT

A baby carrier includes: a belt part configured to be fixed to a waist of a wearer; a hip seat coupled to the belt part and configured to support a hip of a baby; and a fastener part including a first fastening member connected to the belt part and a second fastening member connected to the hip seat and removably coupled to the first fastening member. The hip seat includes a connecting portion fixed to the belt part, a seating portion foldably extending from an upper side of the connecting portion and configured to support a baby, and a support portion foldably extending from a lower side of the connecting portion and configured to support the seating portion. One end portions of the first fastening member and the second fastening member are connected to the belt part and an outer surface of the support portion, respectively.

12 Claims, 8 Drawing Sheets

(56) References Cited

U.S. PATENT DOCUMENTS

| | | | | |
|---|---|---|---|---|
| 5,711,466 | A * | 1/1998 | Kataoka | A47D 13/025 224/159 |
| 9,781,992 | B2 * | 10/2017 | Lee | A47D 13/02 |
| 10,271,664 | B2 * | 4/2019 | Yan | A47D 13/025 |
| 10,349,754 | B2 * | 7/2019 | Kang | A47D 13/025 |

FOREIGN PATENT DOCUMENTS

| | | | |
|---|---|---|---|
| KR | 101359888 | B1 | 2/2014 |
| KR | 20150053584 | A | 5/2015 |
| KR | 20160034547 | A | 3/2016 |
| KR | 200482177 | Y1 | 12/2016 |

* cited by examiner

B–B'

BABY CARRIER

CROSS REFERENCE TO RELATED APPLICATIONS

This application is a National Stage Application of International Application Number PCT/KR2018/001727, filed Feb. 8, 2018; which claims priority to Korean Application No. 10-2017-0084472, filed Jul. 3, 2017.

FIELD OF THE INVENTION

The present invention relates to a baby carrier.

BACKGROUND OF THE INVENTION

A baby carrier is used for conveniently and safely carrying a baby who cannot toddle when a user goes outside with the baby. In the conventional baby carrier, a design using a shoulder belt is mainly used to assist a user in easily carrying a baby on the chest or back. However, in the case of the design using the shoulder belt, the weight of the baby is mostly transmitted to the shoulder of a user through the shoulder belt. In addition, the user should lean the upper body backward or forward to maintain the balance according to the posture of carrying the baby on the chest or back. As a result, the spine of the user may suffer from overload.

In order to solve such a problem, a so-called hip seat has been proposed. In general, the hip seat includes a seat portion, having therein with a support body, on which a baby is seated, a waist band coupled to both sides of the seat portion, and a shoulder belt worn on the shoulder and connected to the seat portion.

In the case of the hip seat, the weight of the baby is dispersed into the shoulder, waist, and pelvis of a wearer of the hip seat so that the wearer can more easily carry the baby. However, due to the excessive volume of the hip seat, it is not easy to store the hip seat.

Therefore, there is a demand for a hip seat that can be easily stored after use.

SUMMARY OF THE INVENTION

Embodiments of the present invention provide a baby carrier that can be easily stored after use.

In accordance with an aspect of the present invention, there is provided a baby carrier including: a belt part configured to be fixed to the waist of a wearer; a hip seat coupled to the belt part and configured to support the hip of a baby; and a fastener part including a first fastening member connected to the belt part and a second fastening member connected to the hip seat and removably coupled to the first fastening member, wherein the hip seat includes a connecting portion fixed to the belt part, a seating portion foldably extending from the upper side of the connecting portion and configured to support a baby, and a support portion foldably extending from the lower side of the connecting portion and configured to support the seating portion when the baby is seated on the seating portion, and one end portion of the first fastening member is connected to the belt part, and one end portion of the second fastening member is connected to an outer surface of the support portion.

Edges of the connecting portion, the seating portion and the support portion may be separably connectable to each other.

The edges of the connecting portion, the seating portion and the support portion may be connected by a zipper.

When the zipper is closed, the seating portion may form an upper surface of the hip seat, the connecting portion may form a rear surface of the hip seat, and the support portion may form a front surface of the hip seat.

When the zipper is closed, the edges of the seating portion, the connecting portion and the support portion may be connected to each other to define an internal space.

The seating portion and the support portion may be provided so as to be foldable toward the connecting portion.

When the seating portion is folded toward the connecting portion, the support portion may be folded to cover an outer surface of the seating portion.

A fastening protrusion may be formed in the other end portion of one of the first fastening member and the second fastening member, and a fastening hole through which the fastening protrusion is inserted may be formed in the other end portion of the other of the first fastening member and the second fastening member.

An engagement guide protruding inward to support the fastening protrusion may be formed in the fastening hole.

A support panel may be provided inside each of the seating portion and the support portion.

A cushion portion may be provided on an upper surface of the seating portion.

At least one pocket may be provided on a front surface of the support portion.

Effect of the Invention

The baby carrier according to an embodiment of the present invention can be easily stored after use.

DETAILED DESCRIPTION OF THE EMBODIMENTS

The advantages and features of embodiments of the present invention and methods of accomplishing them will be clearly understood from the following description of the embodiments taken in conjunction with the accompanying drawings. However, the present invention is not limited to those embodiments and may be implemented in various forms. It should be noted that the embodiments are provided to disclose the invention and also to allow those skilled in the art to know the scope of the present invention. Therefore, the present invention is to be defined only by the scope of the appended claims.

In the following description, well-known functions and/or configurations will not be described in detail if they would unnecessarily obscure the features of the invention. Further, the terms to be described below are defined in consideration of their functions in the embodiments of the invention and may vary depending on a user's or an operator's intention or practice. Accordingly, the definitions of the terms may be made on a basis of the content throughout the specification.

Figure 1:
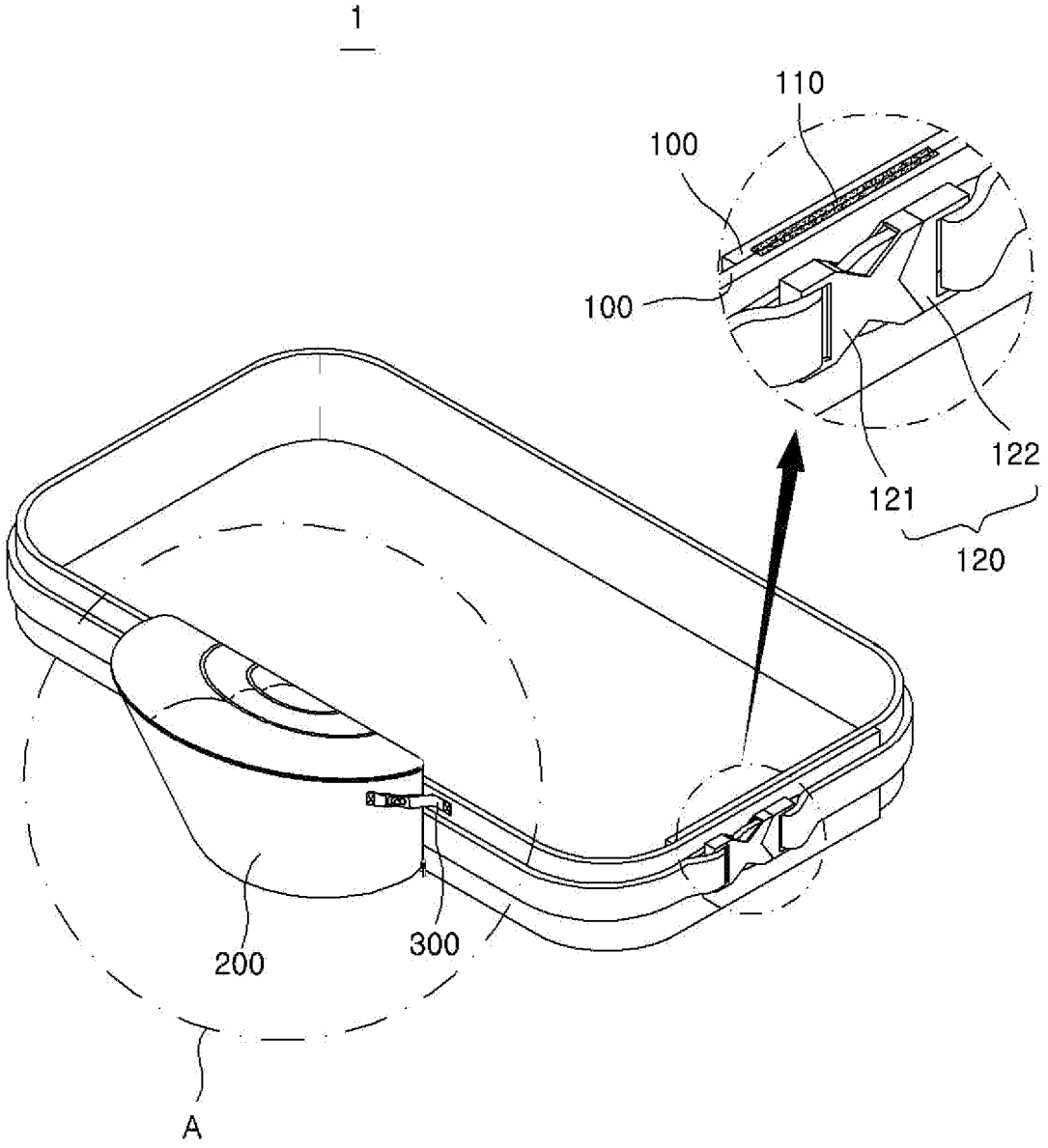
FIG. 1 is a schematic front perspective view of a baby carrier according to an embodiment of the present invention.
Figure 2:
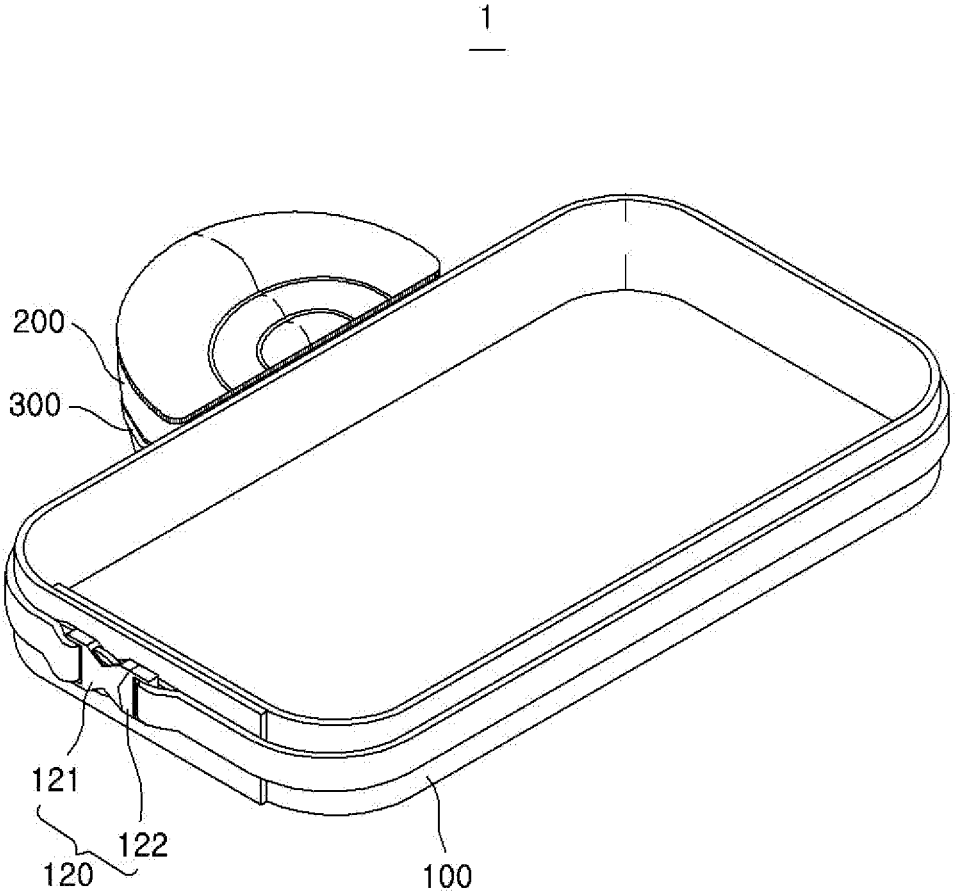
FIG. 2 is a schematic rear perspective view of the baby carrier according to the embodiment.

Further, in the specification, "upper", "lower" and "side" are described based on the illustrations in the drawings, and may be differently expressed when the directions of an object are changed FIG. 1 is a schematic front perspective view of a baby carrier according to an embodiment of the present invention, and FIG. 2 is a schematic rear perspective view of the baby carrier according to an embodiment of the present invention.

Referring to FIGS. 1 and 2, the baby carrier 1 according to an embodiment of the present invention may include a belt part 100 to be fixed to the waist of a wearer, a hip seat 200 on which the hip of a baby is seated, and fastener parts 300 configured to connect the belt part 100 and the hip seat 200.

The belt part 100, which is a member wound around the waist of a wearer, may be made of synthetic resin, synthetic fabric, natural fabric, or the like. Velcro fasteners 110 may be provided at both end portions of the belt part 100. The Velcro fasteners 110 provided at both end portions of the belt part 100 may primarily fasten the belt part 100. That is, the wearer may primarily fasten the belt part 100 to the waist by wrapping the belt part 100 around the waist and then fastening the Velcro fasteners 110 located at both end portions of the belt part 100.

In addition, the belt part 100 may be provided with a buckle portion 120 for more stably fixing the belt part 100 to the wearer's waist. The buckle portion 120 may be coupled to the outer surface of the belt part 100 and may include a female buckle 121 and a male buckle 122, for example.

When both end portions of the belt part 100 are fastened by the Velcro fasteners 110 and fixed to the waist of the wearer, the male buckle 122 is engaged with the female buckle 121 so that the belt part 100 can be stably fixed to the waist of the wearer.

The hip seat 200 may be coupled to the belt part 100. For example, the hip seat 200 may be coupled to the central front side of the belt part 100. Thus, when the belt part 100 is fixed to the waist of the wearer, the hip seat 200 may be located on the front side of the wearer.

Hereinafter, the detailed configuration of the hip seat 200 provided in the baby carrier 1 according to an embodiment of the present invention will be described with reference to FIGS. 3 to 5.

Figure 3:
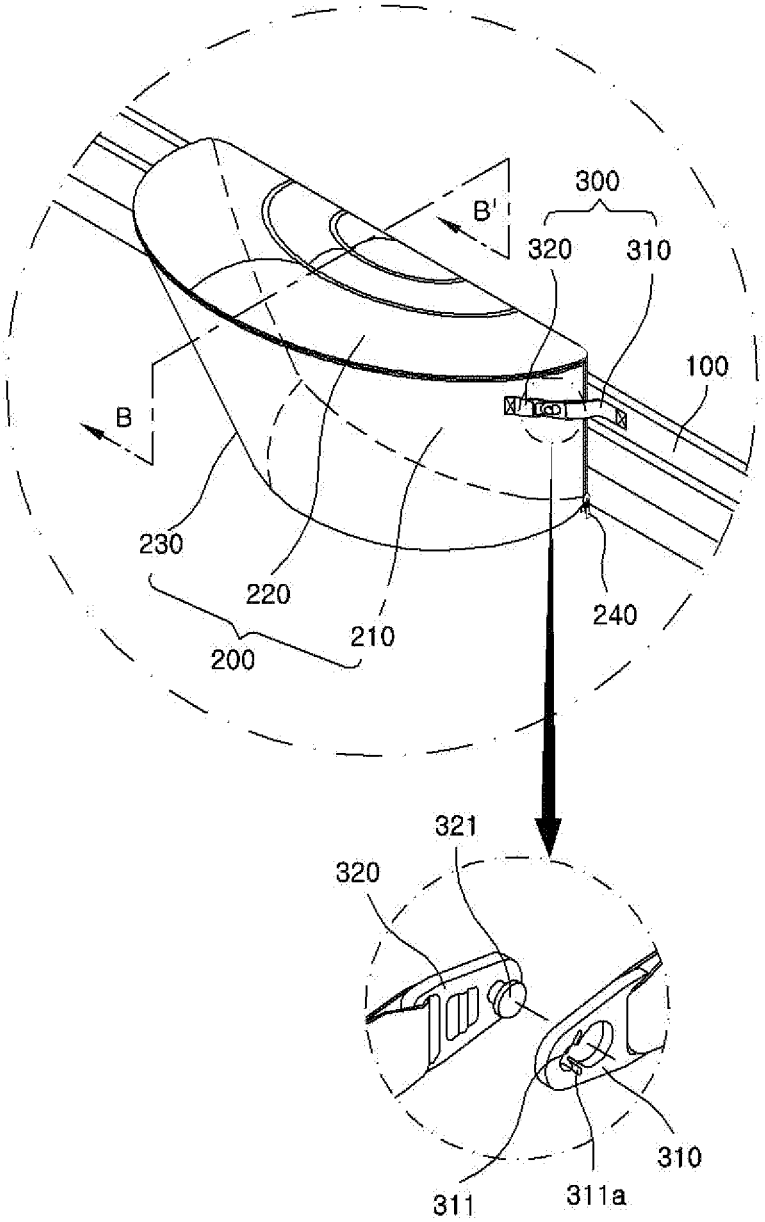
FIG. 3 is an enlarged view of a portion indicated by "A" in FIG. 1.

FIG. 3 is an enlarged view of a portion indicated by "A" in FIG. 1. FIG. 4 is a schematic front perspective view showing a state in which a zipper of the hip seat shown in FIG. 3 is opened. FIG. 5 is a schematic sectional view taken along line B-B' in FIG. 3.

Figure 4:
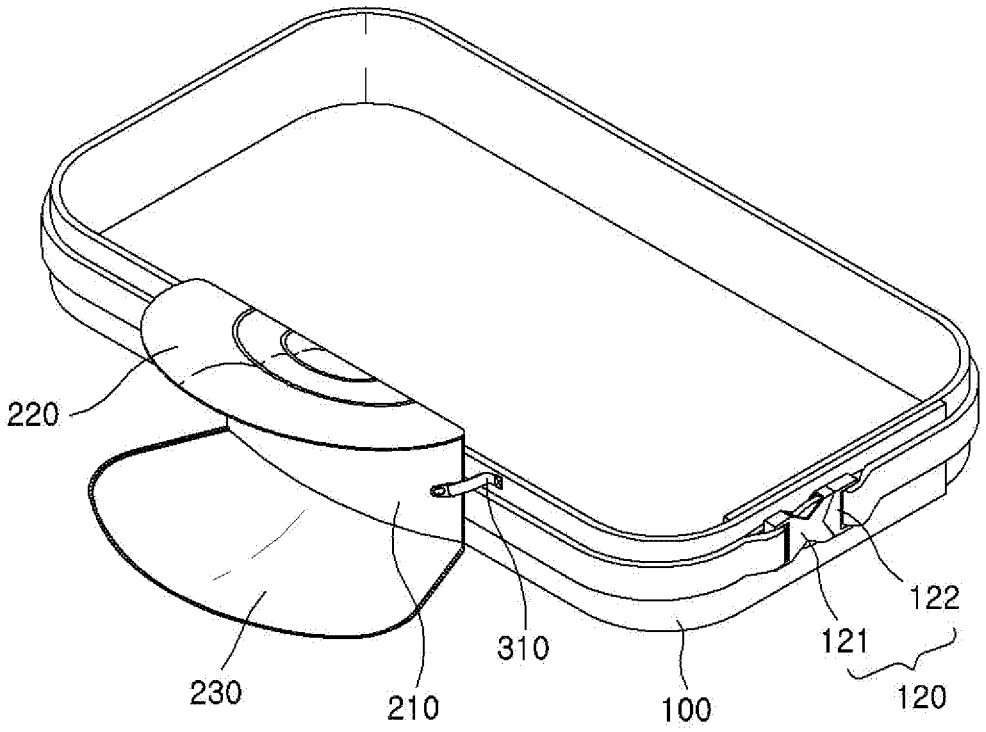
FIG. 4 is a schematic front perspective view showing a state in which a zipper of a hip seat shown in FIG. 3 is opened.
Figure 5:
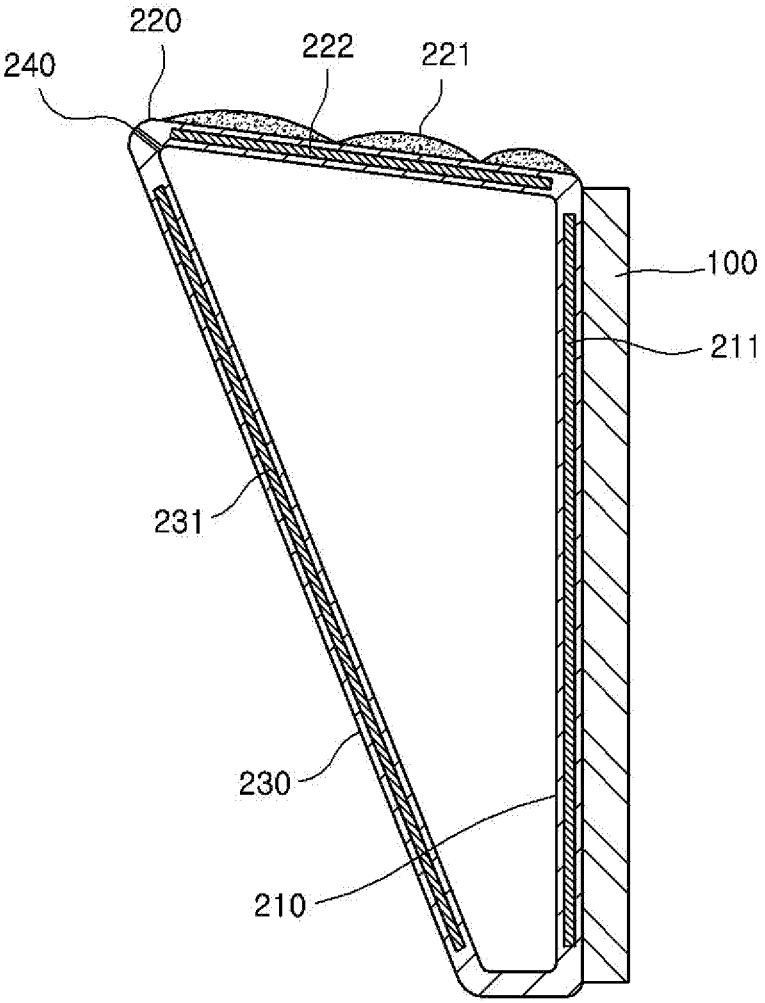
FIG. 5 is a schematic sectional view taken along line B-B' in FIG. 3.

Referring to FIGS. 3 to 5, the hip seat 200 is a member on which the hip of a baby is seated, and may be coupled to the belt part 100. The hip seat 200 may include, for example, a connecting portion 210 fixed to the belt part 100, a seating portion 220 extending from the upper side of the connecting portion 210 to support a baby, and a support portion 230 extending from the lower side of the connecting portion 210 to support the seating portion 220 when the baby is seated.

In this regard, the connecting portion 210, the seating portion 220 and the support portion 230 may be integrally formed as a single unit. In other words, the connecting portion 210, the seating portion 220 and the support portion 230 may be formed in such a fashion that the upper end portion and the lower end portion of a single member are bent. The bent upper end portion may constitute the seating portion 220, and the bent lower end portion may constitute the support portion 230. The intermediate portion connecting the seating portion 220 and the support portion 230 may constitute the connecting portion 210. Alternatively, the connecting portion 210, the seating portion 220 and the support portion 230 may be manufactured as separate members and then may be joined together.

The edges of the connecting portion 210, the seating portion 220 and the support portion 230 may be separably connected to each other. For example, the edges of the connecting portion 210, the seating portion 220 and the support portion 230 may be connected to each other by a zipper 240. When the edges of the connecting portion 210, the seating portion 220 and the support portion 230 are connected by the zipper 240, the seating portion 220 may form the upper surface of the hip seat 200, the connecting portion 210 may form the rear surface of the hip seat 200, and the support portion 230 may form the front surface of the hip sheet 200. When the edges of the connecting portion 210, the seating portion 220 and the support portion 230 are coupled in this manner, the connecting portion 210, the seating portion 220 and the support portion 230 may form a three-dimensional shape so that an internal space is formed therein.

The connecting portion 210 may be coupled to the belt part 100. The seating portion 220 may be coupled to the upper end of the connecting portion 210 so as to be foldable toward the connecting portion 210. In other words, the seating portion 220 may be coupled so as to be foldable toward the front surface of the connecting portion 210. Furthermore, the support portion 230 may be coupled to the lower end of the connecting portion 210 so as to be foldable toward the connecting portion 210. In other words, the support portion 230 may be coupled so as to be foldable toward the front surface of the connecting portion 210. A first support panel 211 may be provided inside the connecting portion 210. The first support panel 211 may maintain the rigidity of the connecting portion 210 and may assist to stably support the hip seat 200 on the abdomen of the wearer.

The seating portion 220 may define the upper surface of the hip seat 200. The hip of the baby may be seated on the seating portion 220. A cushion portion 221 may be provided on the upper surface of the seating portion 220 for comfortable seating of the baby. The cushion portion 221 may be made of a variety of materials, such as sponge, latex, cotton and the like, which are generally used to improve the comfort of the seat.

In addition, a second support panel 222 may be provided inside the seating portion 220. The second support panel 222 may be a member having a predetermined rigidity and may be provided inside the seating portion 220 to maintain the rigidity of the seating portion 220.

The seating portion 220 may be connected at one end to the upper end of the connecting portion 210 in a foldable manner. By providing the seating portion 220 in a foldable manner, the wearer may easily store the baby carrier 1 by minimizing the volume of the hip seat 200 after using the baby carrier 1. A detailed description thereof will be made later.

The support portion 230 may be connected to the lower end of the connecting portion 210 so as to be foldable toward the connecting portion 210. The support portion 230 is a member provided to support the seating portion 220 when the baby is seated on the seating portion 220. The lower end of the support portion 230 may be foldably connected to the lower end of the connecting portion 210, and the upper end of the support portion 230 may be connected to the seating portion 220.

The support portion 230 may have a generally curved outer surface corresponding to the shape of an edge of the seating portion 220. Since the upper edge of the support portion 230 is connected to the edge of the seating portion 220 by the zipper 240, the support portion 230 may be easily connected to the seating portion 220 by forming the outer surface of the support portion 230 in a curved shape. In addition, the side edges of the support portion 230 may be connected to the connecting portion 210.

Furthermore, a third support panel 231 may be provided inside the support portion 230. The third support panel 231 is a member having a predetermined rigidity and may be provided inside the support portion 230 to maintain the rigidity of the support portion 230.

Figure 8:
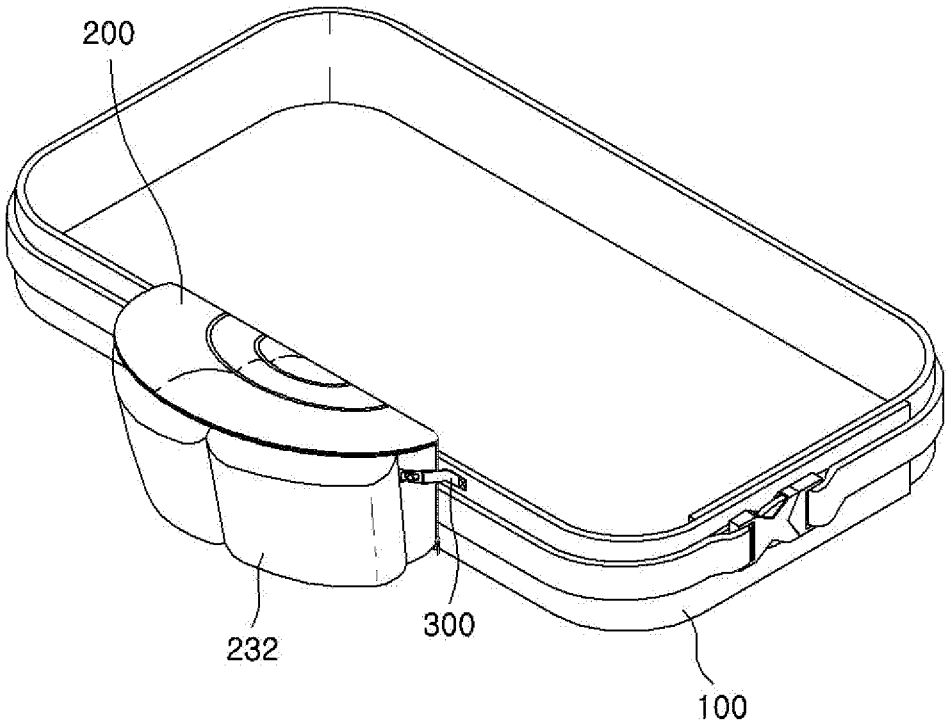
FIG. 8 is a schematic front perspective view of a baby carrier according to another embodiment of the present invention.

Meanwhile, the outer surface of the support portion 230 may be provided with separate pockets 232 for storing objects (see FIG. 8). The number and shape of such pockets 232 may be changed as desired. In other words, although only two pockets 232 are shown in FIG. 8, the present invention is not limited thereto. Further, it is to be understood that the pockets 232 may be a variety of pockets commonly used in the art.

The zipper 240 is provided to connect the edges of the seating portion 210, the connecting portion 220 and the support portion 230. The zipper 240 may be continuously provided in the edges of the seating portion 210, the connecting portion 220 and the support portion 230. When the zipper 240 is closed, the zipper 240 may sequentially connect one side edge of the support portion 230 to the side edge of the connecting portion 210, connect the upper edge of the support portion 230 to the edge of the seating portion 220 and then connect the other side edge of the support portion 230 to the other side edge of the connecting portion 210.

The fastener part 300 is a member provided to assist the support portion 230 in supporting the seating portion 220 while preventing the detachment of the hip seat 200 from the belt part 100. The fastener parts 300 may be respectively provided on both sides of the hip seat 200.

Each of the fastener parts 300 may include a first fastening member 310 coupled to the belt part 100 and a second fastening member 320 coupled to the hip seat 200.

One end portion of the first fastening member 310 may be connected to the belt part 100. A fastening hole 311 through which a below-described fastening protrusion 321 of the second fastening member 320 is inserted may be formed in the other end portion of the first fastening member 310. In addition, an engagement guide 311*a* protruding to support the fastening protrusion 321 may be formed in the fastening hole 311.

One end portion of the second fastening member 320 may be connected to the outer surface of the support portion 230. A fastening protrusion 321 may be formed in the other end portion of the second fastening member 320. The fastening protrusion 321 may be inserted into and coupled to the fastening hole 311.

The fastener parts 300 may connect the hip seat 200 and the belt part 100 to prevent the hip sheet 200 from being separated from the belt part 100 when the baby is seated on the hip seat 200. The fastener parts 300 may prevent the support portion 230 from being pushed away from the connecting portion 220 and being unable to support the seating portion 230.

In addition, the positions where the fastening hole 311 and the fastening protrusion 321 are formed may be exchanged with each other. In other words, the fastening protrusion 321 may be formed on the other end portion of the first fastening member 310, and the fastening hole 311 may be formed on the other end portion of the second fastening member 320.

Hereinafter, another state of the baby carrier according to the embodiment of the present invention will be described with reference to FIGS. 6 and 7. Another state referred to herein may mean a state in which the volume of the hip seat is minimized after the baby carrier has been used.

Figure 6:
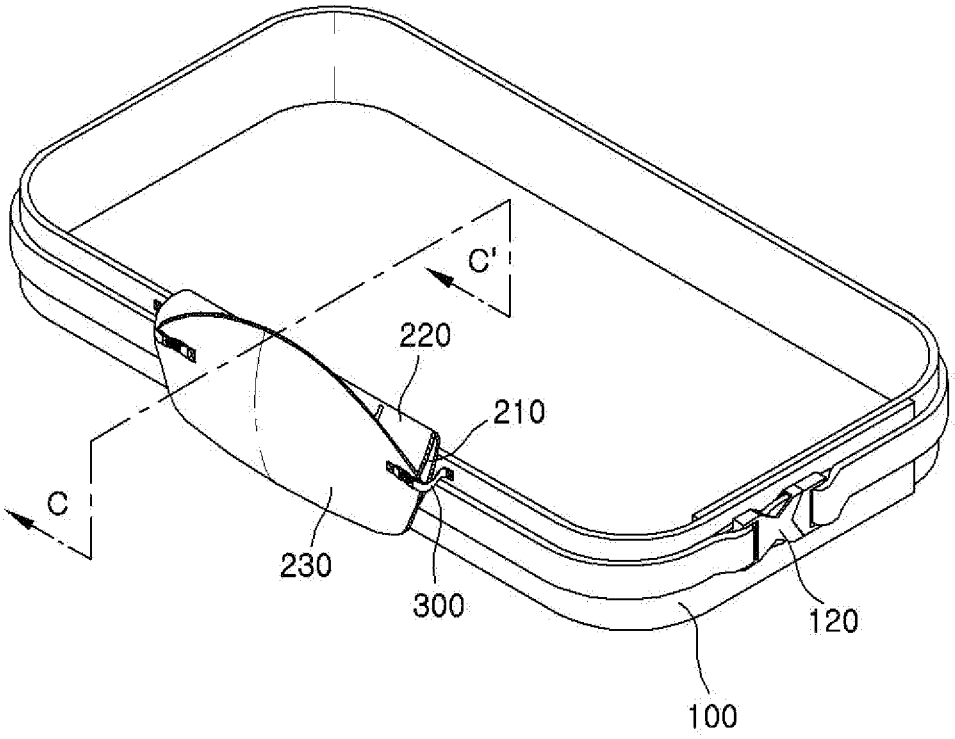
FIG. 6 is a schematic front perspective view showing another state of the baby carrier according to the embodiment.

FIG. 6 is a schematic front perspective view showing another state of the baby carrier according to an embodiment of the present invention. FIG. 7 is a schematic sectional view taken along line C-C' in FIG. 6.

Figure 7:
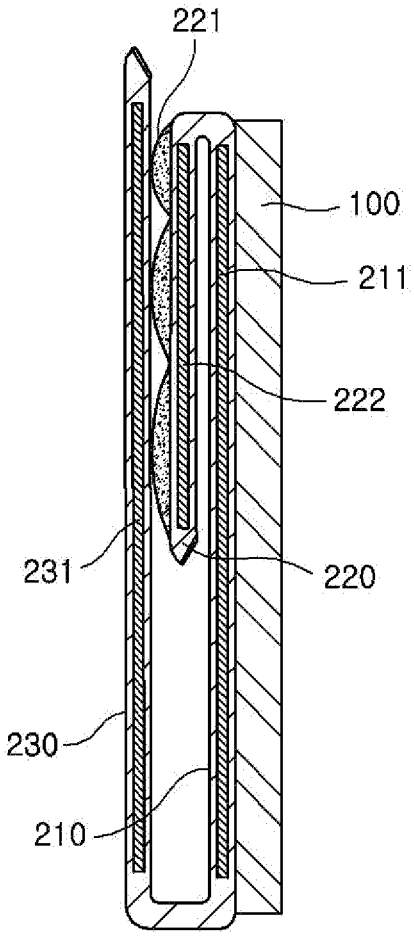
FIG. 7 is a schematic sectional view taken along line C-C' in FIG. 6.

Referring to FIGS. 6 and 7, when the use of the hip seat 200 is no longer necessary, the user may first open the zipper 240 to release the fastening state of the edges of the connecting portion 210, the seating portion 220 and the support portion 230. Then, the seating portion 220 may be folded toward the connecting portion 210, and the support portion 230 may be folded to cover the outer surface of the seating portion 220. The first fastening member 310 and the second fastening member 320 may be engaged with each other after the seating portion 220 and the support portion 230 are folded. By fastening the first and second fastening members 310 and 320 to each other in a state in which the support portion 230 covers the outer surface of the seating portion 220, the hip seat 200 may be kept in a folded state.

As described above, in the case of the baby carrier 1 according to the embodiment of the present invention, when the use of the hip seat 200 is completed, the hip seat 200 is coupled to the belt part 100 in a superposed form. This makes it possible to minimize the volume of the hip seat 200.

From the foregoing, it will be appreciated that various embodiments of the present invention have been described herein for purposes of illustration, and that various modifications may be made without departing from the scope and spirit of the present invention. The embodiments disclosed in the specification of the present invention do not limit the present invention. The scope of the present invention will be interpreted by the claims below, and it will be construed that all techniques within the scope equivalent thereto belong to the scope of the present invention.

What is claimed is:

1. A baby carrier, comprising:

a belt part configured to be fixed to a waist of a wearer;

a hip seat coupled to the belt part and configured to support a hip of a baby; and a fastener part including a first fastening member connected to the belt part and a second fastening member connected to the hip seat and removably coupled to the first fastening member, wherein the hip seat includes a connecting portion fixed to the belt part, a seating portion foldably extending from an upper side of the connecting portion and configured to support a baby, and a support portion foldably extending from a lower side of the connecting portion and configured to support the seating portion when the baby is seated on the seating portion, and one end portion of the first fastening member is connected to the belt part, and one end portion of the second fastening member is connected to an outer surface of the support portion.

2. The baby carrier of claim 1, wherein edges of the connecting portion, the seating portion and the support portion are separably connectable to each other.

3. The baby carrier of claim 2, wherein the edges of the connecting portion, the seating portion and the support portion are connected by a zipper.

4. The baby carrier of claim 3, wherein when the zipper is closed, the seating portion forms an upper surface of the hip seat, the connecting portion forms a rear surface of the hip seat, and the support portion forms a front surface of the hip seat.

5. The baby carrier of claim 3, wherein when the zipper is closed, the edges of the seating portion, the connecting portion and the support portion are connected to each other to define an internal space.

6. The baby carrier of claim 1, wherein the seating portion and the support portion are provided so as to be foldable toward the connecting portion.

7. The baby carrier of claim 6, wherein when the seating portion is folded toward the connecting portion, the support portion is folded to cover an outer surface of the seating portion.

8. The baby carrier of claim 1, wherein a fastening protrusion is formed in the other end portion of one of the first fastening member and the second fastening member, and a fastening hole through which the fastening protrusion is inserted is formed in the other end portion of the other of the first fastening member and the second fastening member.

9. The baby carrier of claim 8, wherein an engagement guide protruding to support the fastening protrusion is formed in the fastening hole.

10. The baby carrier of claim 1, wherein a support panel is provided inside each of the seating portion and the support portion.

11. The baby carrier of claim 1, wherein a cushion portion is provided on an upper surface of the seating portion.

12. The baby carrier of claim 1, wherein at least one pocket is provided on a front surface of the support portion.

* * * * *